US007384124B2

(12) United States Patent
Yang

(10) Patent No.: US 7,384,124 B2
(45) Date of Patent: Jun. 10, 2008

(54) CARRIAGE FOR INK CARTRIDGE OF IMAGE FORMING APPARATUS

(75) Inventor: Yong-sok Yang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 384 days.

(21) Appl. No.: 10/757,995

(22) Filed: Jan. 16, 2004

(65) Prior Publication Data

US 2004/0183856 A1 Sep. 23, 2004

(30) Foreign Application Priority Data

Jan. 17, 2003 (KR) ..... 2003-3430
Apr. 21, 2003 (KR) ..... 10-2003-0025233

(51) Int. Cl.
*B41J 23/00* (2006.01)
*B41J 2/14* (2006.01)

(52) U.S. Cl. ..... 347/37; 347/49

(58) Field of Classification Search ..... 347/37, 347/49, 50, 85, 87, 86
See application file for complete search history.

(56) References Cited

U.S. PATENT DOCUMENTS 5,627,577 A * 5/1997 Buican ..... 347/50
5,629,725 A * 5/1997 Buican ..... 347/49
6,170,940 B1 * 1/2001 Shinada et al. ..... 347/86
6,190,010 B1 2/2001 Tanaka
6,250,750 B1 * 6/2001 Miyazawa et al. ..... 347/87
6,312,105 B1 * 11/2001 Miyauchi ..... 347/49
6,481,829 B1 * 11/2002 Bailey et al. ..... 347/49
6,502,917 B1 * 1/2003 Shinada et al. ..... 347/19
6,637,863 B2 * 10/2003 Jones ..... 347/49
6,655,793 B2 * 12/2003 Jones et al. ..... 347/86
6,705,706 B2 * 3/2004 Browning et al. ..... 347/50
6,736,486 B2 * 5/2004 Nakamura et al. ..... 347/49
2002/0146267 A1 * 10/2002 Jones ..... 400/354

FOREIGN PATENT DOCUMENTS

CN 1179385 4/1998
CN 1272081 11/2000
JP 10-157162 6/1998

OTHER PUBLICATIONS

Chinese Office Action for Application No. 200410001965.9.

* cited by examiner

*Primary Examiner*—Stephen D. Meier
*Assistant Examiner*—Rene Garcia, Jr.
(74) *Attorney, Agent, or Firm*—Staas & Halsey LLP

(57) ABSTRACT

A carriage for an ink cartridge of an image forming apparatus employing an improved locking structure that draws out the ink cartridge with a simple unlocking thereof, thereby improving a user convenience in replacing the ink cartridge. The carriage for the ink cartridge of the ink jet printer has: a carriage body with a mounting portion, in which the ink cartridge is accommodated; a latch rotatably disposed at the carriage body to open and close the mounting portion; a resilient latch member to resiliently bias the latch in an opening direction; and a locking unit to lock the latch to the carriage body, wherein when the latch is unlocked with respect to the carriage body, the locking unit rotates together with the latch, and draws out the ink cartridge from the mounting portion.

24 Claims, 14 Drawing Sheets

CARRIAGE FOR INK CARTRIDGE OF IMAGE FORMING APPARATUS

CROSS-REFERENCE TO RELATED APPLICATIONS

This application claims the benefit of Korean Patent Application No. 2003-3430, filed Jan. 17, 2003, in the Korean Intellectual Property Office, and Korean Patent Application No. 2003-25233, filed Apr. 21, 2003, the disclosures of which are incorporated herein by reference.

BACKGROUND OF THE INVENTION

1. Field of the Invention

The present invention relates to an image forming apparatus, such as an ink jet printer, and more particularly, to a carriage for an ink cartridge of an ink jet printer having an improved latch system, which enables easy mounting and releasing of the ink cartridge.

2. Description of the Related Art

An ink jet printer ejects droplets of printing ink on a desired position to create a desired image on a paper. The printing ink is generally contained in an ink cartridge that is removably mounted in the ink jet printer. A structure of such a removable ink cartridge is disclosed in Japanese Publication No. 10-157162.

FIG. 1 is a cross sectional view showing a carriage for an ink cartridge of a conventional image forming apparatus, such as an ink jet printer, in which reference numerals 10, 13, 15, and 20 indicate a carriage, a guide rod, a snap hook, and a locking lever, respectively.

The carriage 10 is provided with a nozzle unit 12 in a carriage body 11, and the carriage 10 accommodates an ink cartridge 14 in connection with the nozzle unit 12. The carriage 10 reciprocally moves along the guide rod 13, and the ink cartridge 14 is secured in position as the snap hook 15 is hooked into the locking lever 20.

The carriage body 11 includes a shaft supporting portion 11*a*, on which the locking lever 20 is hinged, and an opening 11*b*, which allows the ink cartridge 14 to be removed from the carriage 10.

The locking lever 20 includes a rotary shaft 21, a cover plate 22, and a knob 23, and is secured to the carriage body 11 by the snap hook 15.

The rotary shaft 21 includes the shaft supporting portion 11*a* of the carriage body 11. The locking lever 20 pivots on the rotary shaft 21.

The cover plate 22 protects the ink cartridge 14 accommodated in the carriage body 11, and has protrusions 26 positioned on center portions of the cover plate 22. The protrusions 26 function to compress the ink cartridge 14 to lock the ink cartridge in the carriage 10.

The cover plate 22 is provided with a window 24 positioned thereon. The window 24 is sized to allow a pole type head 15*b* of the snap hook 15 to be inserted when the locking lever 20 is completely pivoted to a locking position.

The snap hook 15 includes a cantilever 15*a* and the pole type head 15*b*.

The cantilever 15*a* deforms as the locking lever 20 moves to the locking position, and then snaps back to a non-stress state after the locking lever 20 reaches the locking position.

The pole type head 15*b* passes through the window 24, and is held by the knob 23, thereby locking the locking lever 20.

The knob 23 has a sliding slant 25 so that the pole-shaped head 15*b* of the snap hook 15 smoothly locks onto the knob 23.

In the carriage 10 constructed as above, to remove the ink cartridge 14, the cantilever 15*a* is first pushed in a direction "A". Accordingly, the pole type head 15*b* is released through the window 24. The locking lever 20 is pivoted through a predetermined range by a recovering force of a pressure occurring when the protrusions 26 press the ink cartridge 14, to thus be released from the locking position. A user then opens the locking lever 20 to a full extent with her/his hands to replace the ink cartridge 14 with a new one.

But since such a locking device including the locking lever 20 mainly uses a resilient member such as the snap hook 15, a problem occurs if the resilient force is decreased or if the resilient member deforms due to repeated use. In this case, the ink cartridge 14 is not locked in the carriage 10 securely, and frequently unlocks as external shocks are applied.

Further, to remove the ink cartridge 14, a user is required to press the snap hook 15, manually pivot the locking lever 20, and then remove the ink cartridge 14 uprightly. Thus, the user experiences inconvenience, and an ink cartridge locking device that has an improved locking force and provides user convenience has been demanded.

SUMMARY OF THE INVENTION

The present invention has been developed to solve the above and/or other problems in the related art. Accordingly, an aspect of the present invention provides a carriage for an ink cartridge of an image forming apparatus such as an ink jet printer, employing an improved locking structure, which guarantees a secure locking.

Another aspect of the present invention provides a carriage for an ink cartridge of an image forming apparatus such as an ink jet printer, in which the ink cartridge is drawn out with a simple unlocking thereof, thereby improving a user convenience in replacing the ink cartridge.

To achieve the above and/or other aspects, a carriage for an ink cartridge of an image forming apparatus is provided, and has: a carriage body with a mounting portion, in which the ink cartridge is accommodated, a latch rotatably disposed at the carriage body to open and close the mounting portion, a resilient latch member to resiliently bias the latch in an opening direction, and a locking unit to lock the latch to the carriage body, wherein when the latch is unlocked with respect to the carriage body, the locking unit rotates together with the latch, and draws out the ink cartridge from the mounting portion.

According to one aspect, the locking unit comprises: a locking projection disposed at a first wall of the carriage body, a hook member, hinged on the latch to be selectively hooked with the locking projection, that when the latch is released, the hook member hooks with the ink cartridge, and a release handle to release the hook member from the locking projection.

According to one aspect, the hook member comprises: an ascending protrusion that hooks with the ink cartridge to lift the ink cartridge when the latch is released.

According to one aspect, a pair of the hook members is disposed on opposing walls of the carriage body, with the ink cartridge being selectively interposed therebetween.

According to one aspect, the release handle is disposed at the latch coaxially with the hook member. According to another aspect, the release handle is disposed at the latch on a different axis than the hook member.

According to one aspect, the locking unit further comprises a resilient release handle member interposed between the release handle and the hook member, to resiliently compress the hook member to closely contact the locking projection.

According to one aspect, the hook member, the locking projection and the ascending protrusion are respectively provided with sliding slants, and when a user presses an upper surface of the latch, the sliding slants on the hook member and the locking projection slide on each other to lock the latch.

To achieve the above and/or other aspects, a carriage for an ink cartridge of an image forming apparatus is provided, which comprises: a carriage body with a mounting portion, in which the ink cartridge having a latching portion is accommodated, a latch rotatably disposed at the carriage body to close the mounting portion by locking, that when unlocking with respect to the carriage body, draws the ink cartridge out of the mounting portion, a resilient latch member to resiliently bias the latch in an opening direction, and a locking unit to lock the latch to the carriage body.

According to one aspect, the latch comprises a latch body, and a guide arm extended from the latch body to guide both side surfaces of the ink cartridge. According to one aspect, the guide arm comprises a first guide portion that hooks into the latching portion to lift the ink cartridge, when the latch is unlocked, and a second guide portion extended stepwise from the first guide portion to guide a side of the latching portion.

According to one aspect, the locking unit comprises a locking projection disposed at a sidewall of the carriage body, a hook member hinged on the latch and selectively hooked into the locking projection, and a release handle to release the hook member from the locking projection.

According to one aspect, the carriage further comprises a sliding unit that limits an opening angle of the latch with respect to the carriage body.

According to one aspect, the sliding unit comprises a sliding protrusion disposed on the latch; and a sliding hole portion disposed on the carriage body opposite to the sliding protrusion, to accommodate the sliding protrusion.

According to one aspect, the sliding hole portion comprises a first penetrating hole receiving the sliding protrusion at a first position when the latch is locked, a second penetrating hole receiving the sliding protrusion at a second position when the latch is opened, and a connection portion connecting the first and the second penetrating holes.

According to one aspect, the connection portion has a distance defined between opposing surfaces thereof that is smaller than a diameter of the sliding protrusion.

According to one aspect, a first imaginary line, which is parallel to an upper surface of the latch in a locked position, and a second imaginary line, which is parallel to the upper surface of the latch in an opened position, form an interior angle ranging from about 20° to about 30°. According to one aspect, the interior angle is approximately 21°.

Additional aspects and/or advantages of the invention will be set forth in part in the description which follows and, in part, will be obvious from the description, or may be learned by practice of the invention.

BRIEF DESCRIPTION OF THE DRAWINGS

The above/or and other aspects, features, and advantages of the present invention will be more apparent from the following detailed description of the embodiments, taken in conjunction with the accompanying drawings, in which.

DETAILED DESCRIPTION

Figure 1:
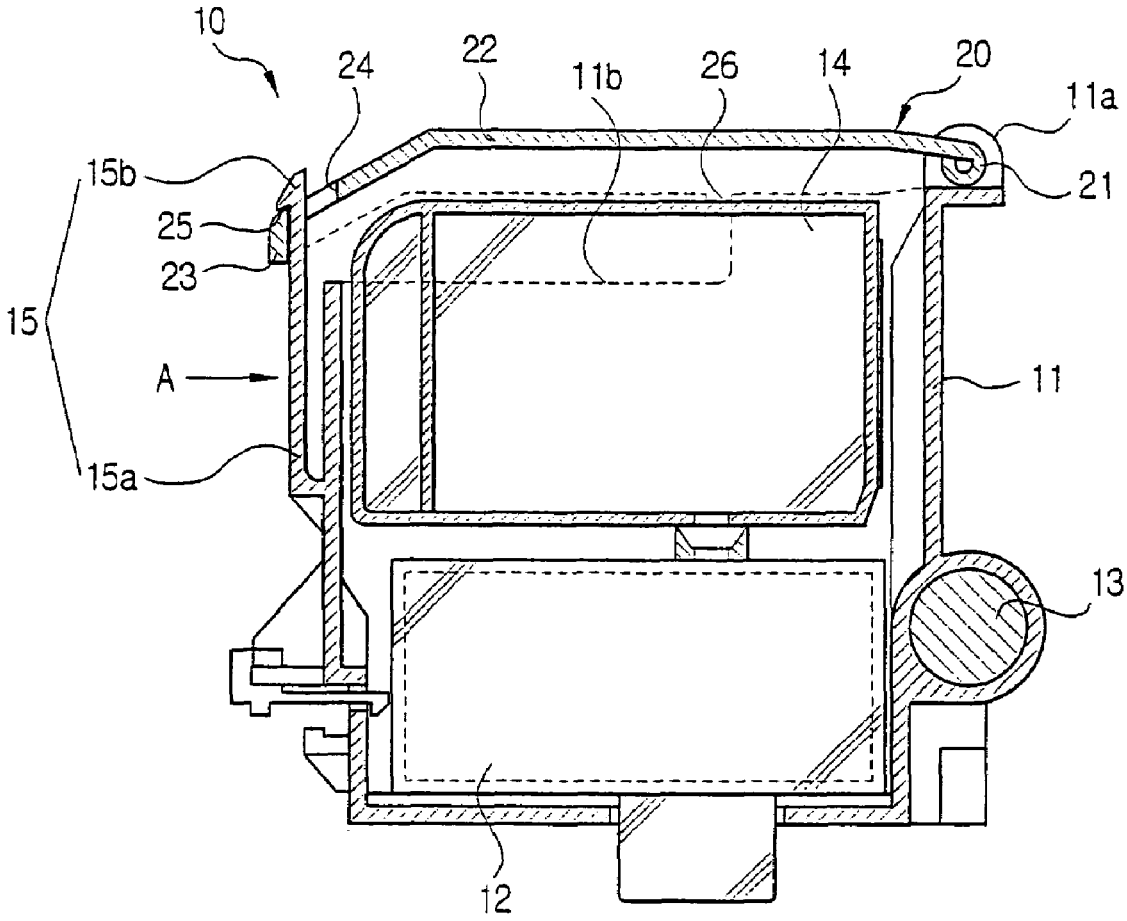
FIG. 1 (PRIOR ART)
FIG. 1 is a cross sectional view showing a conventional carriage for an ink cartridge.

Reference will now made in detail to embodiments of the present invention, examples of which are illustrated in the accompanying drawings, wherein like reference numerals refer to the like elements throughout. The embodiments described below explain the present invention by referring to the figures.

Referring to FIGS. 2 through 7 showing a first embodiment according to the present invention, there are provided an ink cartridge 110, a guide rail 120, and a carriage 130. The carriage body 131 reciprocally moves along the guide rail 120.

The carriage 130 includes a carriage body 131, a latch 132, a resilient latch member 133, and a locking unit 200. The carriage body 131 is provided with a mounting portion 134 on which the ink cartridge 110 is mounted.

The latch 132 is pivotably disposed at the carriage body 131 to open and close an open portion of the carriage body 131, through which the ink cartridge 110 is mounted, and removed.

Meanwhile, on a surface of the latch 132 opposite to the ink cartridge 110, there is provided a plunger 135, with a spring 136 interposed between the surface of the latch 132 and the plunger 135. As the latch 132 is locked, the plunger 135 compresses the ink cartridge 110 using a resilient force of the spring 136 to secure a head of the ink cartridge 110 in a mounted position.

The resilient member 133 resiliently biases the latch 132 in an opening direction. Due to the presence of the resilient member 133, the opening of the latch 132 is easily performed.

The locking unit 200 locks the latch 132 in a closed position, and includes a hook member 210, a release handle 220, and a locking projection 230.

The hook member 210 is pivotably disposed at the latch 132, and has a locking protrusion 211 locked in the locking projection 230 and an ascending protrusion 212 positioned on a surface of the hook member 210, opposite to the ink cartridge 110.

The ascending protrusion 212 (see FIG. 5) hooks into a latching portion 111 disposed at an upper portion of the ink cartridge 110, when the latch 132 is opened by the release handle 220. Accordingly, the ink cartridge 110 is lifted up by the ascending protrusion 212, and is separated from the carriage body 131.

According to one aspect, a pair of hook members 210 are provided, with the ink cartridge interposed therebetween. Accordingly, the ascending protrusions 212 support the latching portions 111 at opposing sides of the ink cartridge 110, to thereby prevent the ink cartridge 110 from deviating from a predetermined path while being removed.

The release handle 220 pivots the hook member 210 in an unlocking direction, and according to one aspect, the release handle 220 is hinged on the latch 132, where the hook member 210 is disposed, so that the release handle 220 pivots on the same rotary shaft as the hook member 210. In this case, together with the lifting of the release handle 220 in an arrowed direction of FIG. 3, the hook member 210 is concurrently rotated and released from the locking projection 230.

According to one aspect, the release handle 220 is further provided with a resilient release handle member 221 to bias the hook member 210 toward the locking projection 230. According to one aspect, the resilient release handle member 221 comprises a spring mounted on an axis of rotation of the release handle 220. When the release handle 220, including the resilient release handle member 221, is no longer controlled by a user, the release handler 220 automatically returns to an initial position, and as a result, user convenience is improved.

The locking projection 230 is disposed at a sidewall of the carriage body 131 to engage the hook member 210.

As shown in FIGS. 2 to 7, according to one aspect, the locking projection 230, the locking protrusion 211, and the ascending protrusion 212 of the hook member 210, respectively, have sliding slants. Due to the presence of the sliding slants, the hook member 210 is easily hooked into the locking projection 230 in the locking of the latch 132 and requires less effort from a user than the conventional inkjet carriage. Also, if the release handle 220 is not controlled by the user in an opening direction of the latch 132, the locking state is maintained.

Reference will now be made to the operation of mounting and removing the ink cartridge from the carriage 130, with reference to the accompanying drawings.

Figure 2:
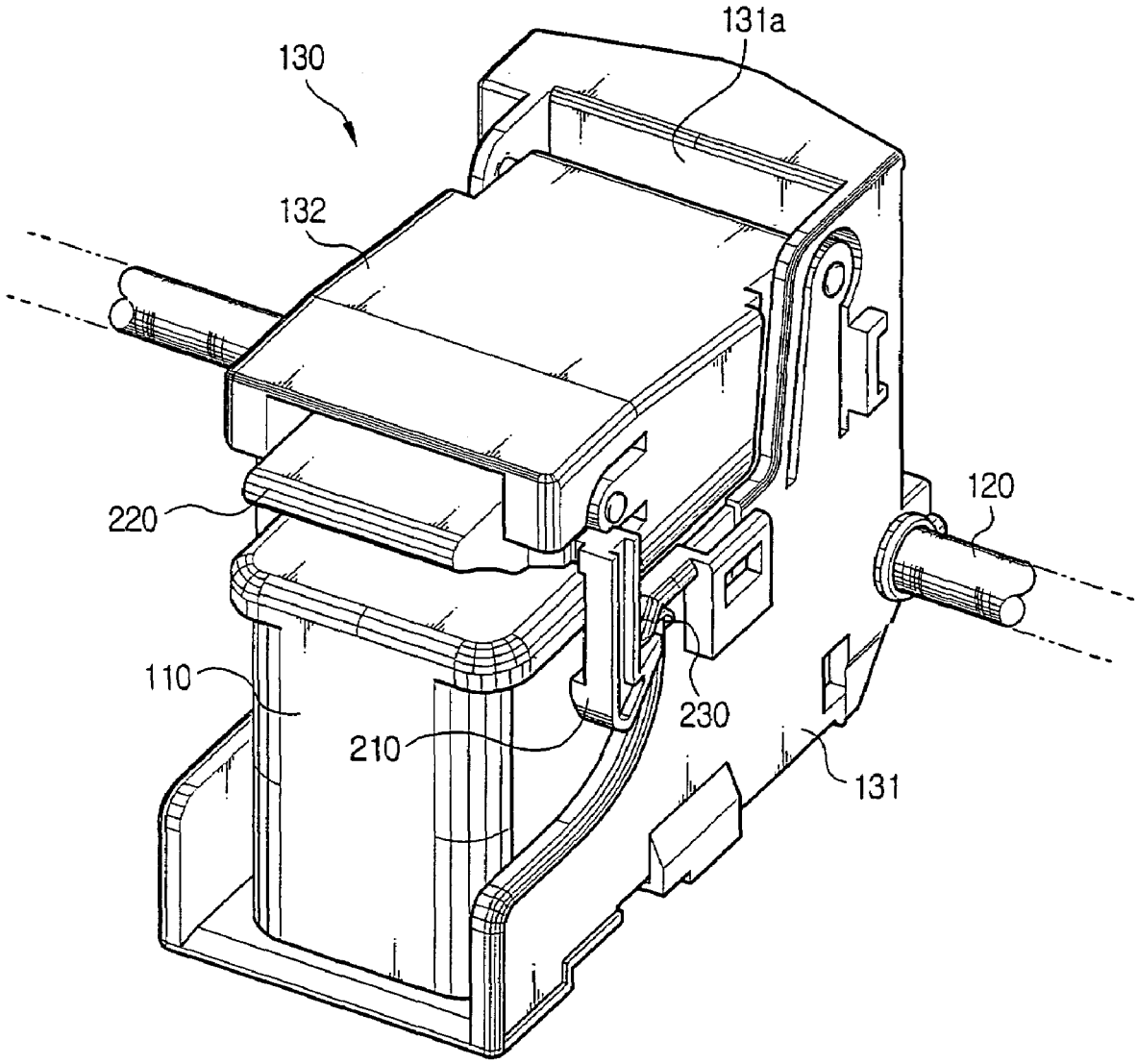
FIG. 2 is a perspective view showing a carriage for an ink cartridge according to a first embodiment of the present invention.
Figure 3:
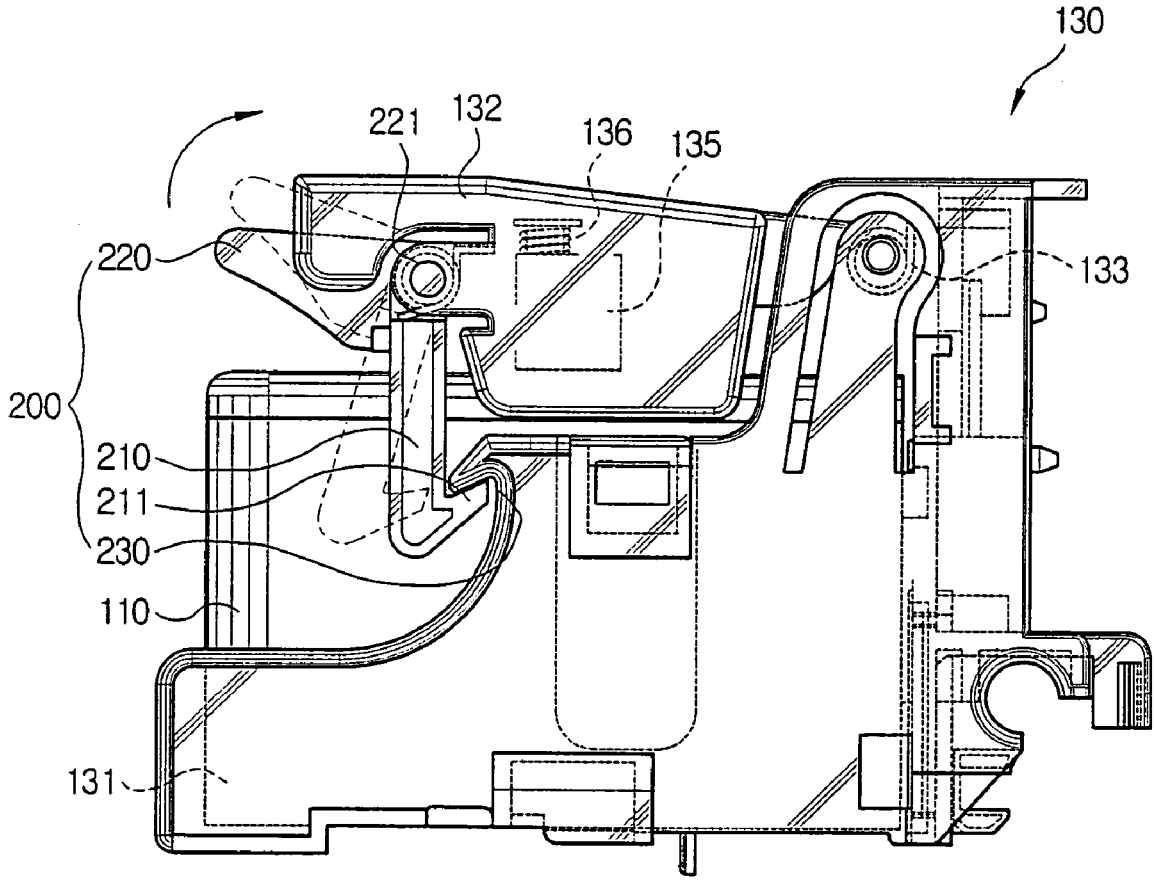
FIG. 3 is a side elevation view of FIG. 2.

Referring to FIGS. 2 and 3, the ink cartridge 110 is received in the mounting portion 134 of the carriage body 131, and secured therein by the locking unit 200.

When the ink cartridge 110 is completely consumed, and thus has to be replaced with a new one, a user presses the latch 132 with his/her thumb and lifts up the release handle 220 in the arrowed direction of FIG. 3 with his/her index finger or middle finger. As the release handle 220 is lifted, the hook member 210 assembled with a hinge portion of the latch 132 together with the release handle 220 is concurrently rotated in an unlocking direction, i.e., in the arrowed direction of FIG. 3.

Figure 4:
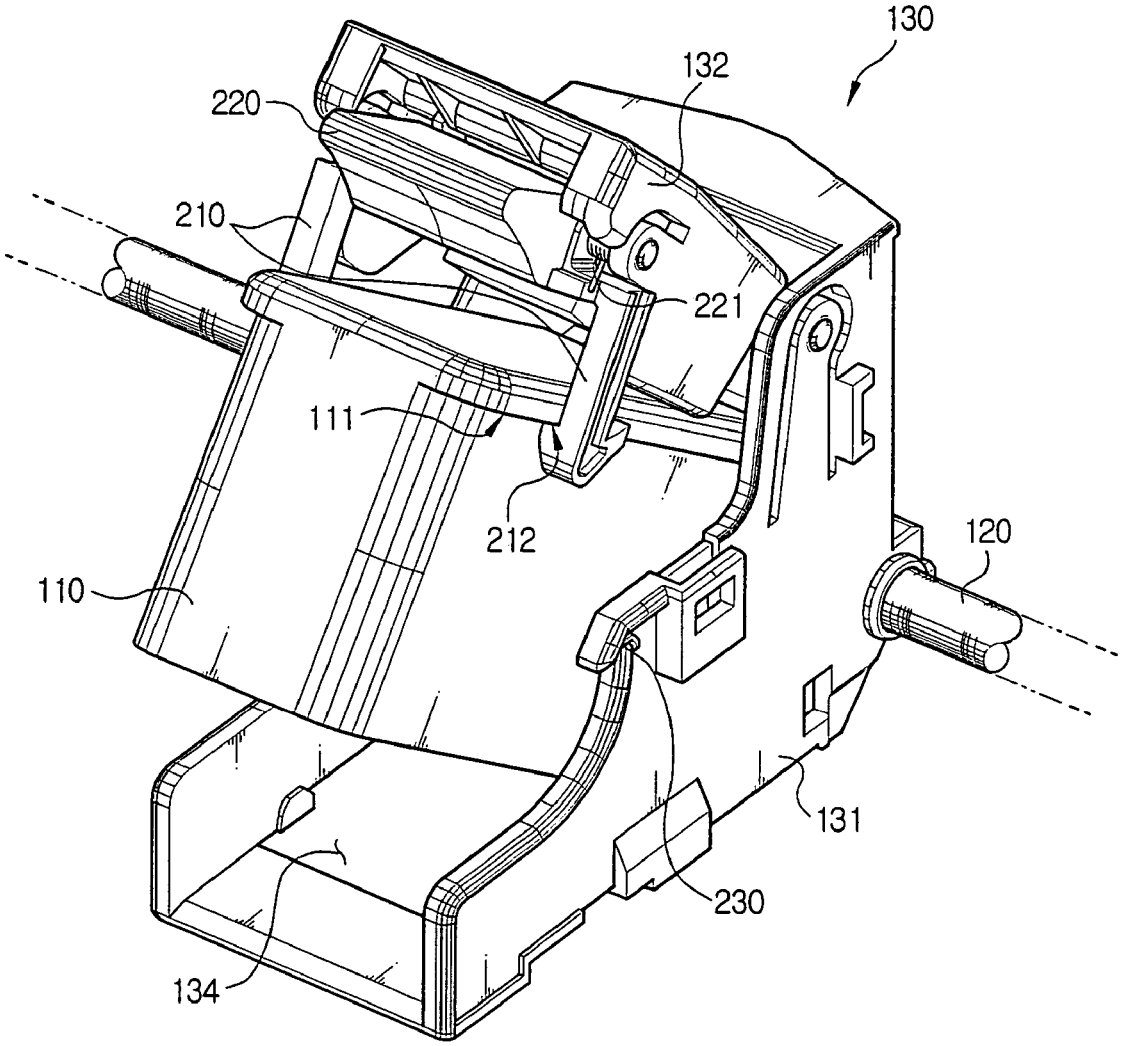
FIG. 4 is a perspective view showing the carriage for the ink cartridge of FIG. 2, with the latch being released open.

Accordingly, as the hook member 210 engaged with the locking projection 230 for a locking state is rotated in the unlocking direction, the latch 132 releases from the locking state, and as shown in FIG. 4, the latch 132 receives a rotation force in the opening direction due to the resilient recovering force of the resilient latch member 133 and the spring 136.

Figure 5:
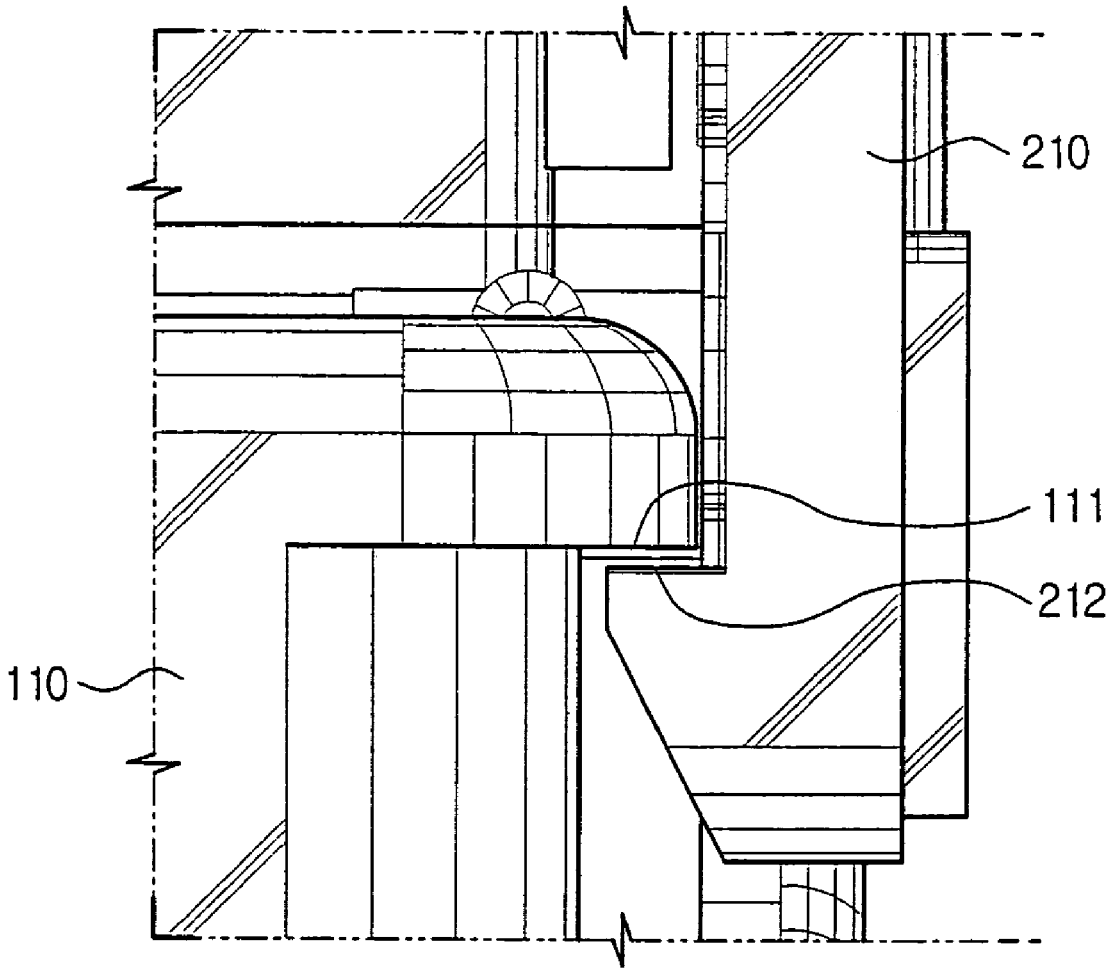
FIG. 5 is a front view showing main parts of FIG. 4.
Figure 6:
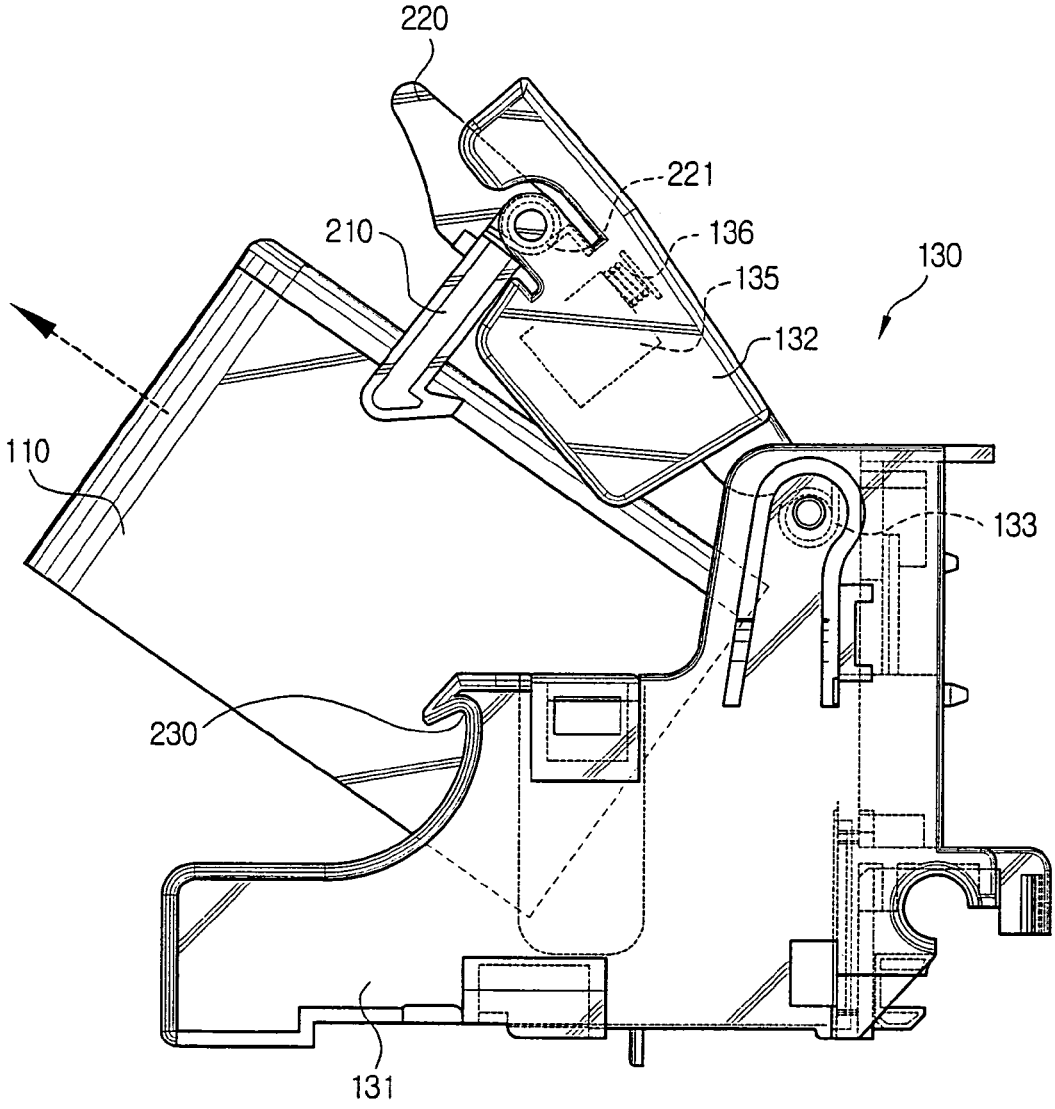
FIG. 6 is a side elevation view of FIG. 4.

Accordingly, the latch 132 released from the locking state is opened to a maximum extent by the user, as shown in FIGS. 4 to 6, to allow the ink cartridge 110 to be removed in an arrowed direction of FIG. 6.

As is also shown in FIGS. 5 and 6, the ascending protrusion 212, which protrudes out of the surface of the locking member 210 opposite to the ink cartridge 110, pivots in conjunction with the opening of the latch 132, as the latch 132 is opened by a user.

According to one aspect, the latching portion 111 is positioned along an external perimeter of the ink cartridge 110. The ascending protrusion 212 pivots while the latching portion 111 engages the ascending protrusion 212, thereby raising the ink cartridge 110 into a position to be removed from the mounting portion 134. According to one aspect, the latching portion 111 is positioned along an upper and outer perimeter of the ink cartridge 110. This is to maximize a moment applied by the ascending protrusion 212, to enable the user to remove the ink cartridge 110 with less effort.

Accordingly, when a user rotates the latch 132 and opens the carriage body 131, the ink cartridge 110 can be easily removed from the mounting portion 134 of the carriage 130 due to the presence of the ascending protrusion 212.

Figure 7:
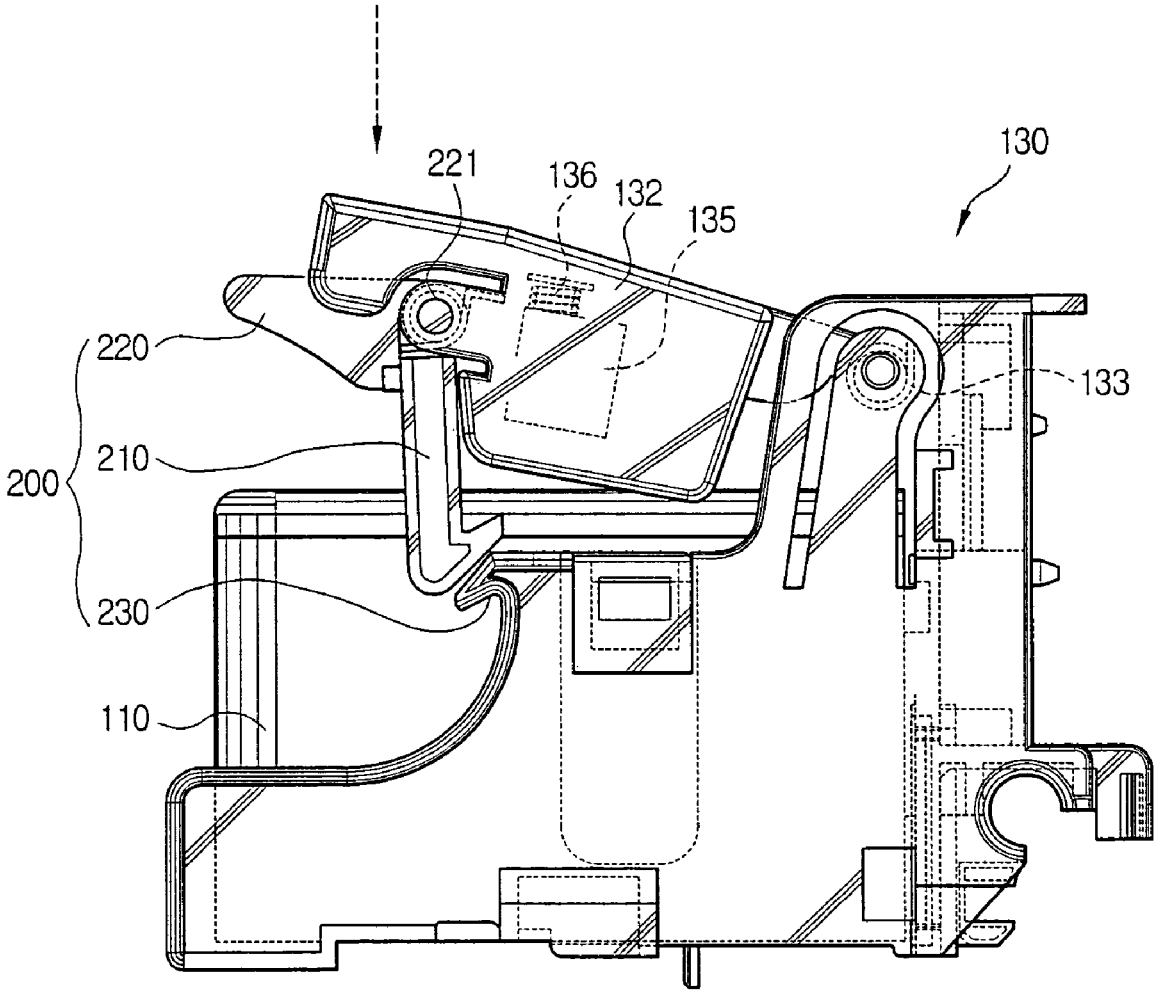
FIG. 7 is a side elevation view showing the carriage for the ink cartridge of FIG. 2 with the latch being locked.

After the used ink cartridge 110 is removed, a new ink cartridge 110 full of ink is mounted in the carriage 130. That is, as shown in FIG. 7, the ink cartridge 110 is placed in the mounting portion 134 of the carriage 130. Then, the latch 132 is rotated in the locking direction, opposite the unlocking direction, and is then pressed by the user in an arrowed direction of FIG. 7. The hook member 210 slides on the sliding slant of a contact surface contacting with the locking projection 230, and then engages the locking projection 230, to accomplish the locking.

At this point, since the ascending protrusion 212 positioned on the surface of the hook member 210 opposite to the ink cartridge 110 also includes the sliding slant, as shown in FIG. 5, the ascending protrusion 212 slides on the latching portion 111 positioned along the external perimeter of the ink cartridge 110, so that the hook member 210 is engaged with the locking projection 230. Also, the plunger 135 provided on the latch 132 resiliently compresses the ink cartridge 110, thereby firmly securing the ink cartridge 110 to the mounting portion 134 of the carriage 130.

Reference will now be made to the carriage for the ink cartridge according to a second embodiment of the present invention with reference to the accompanying drawings.

Figure 8:
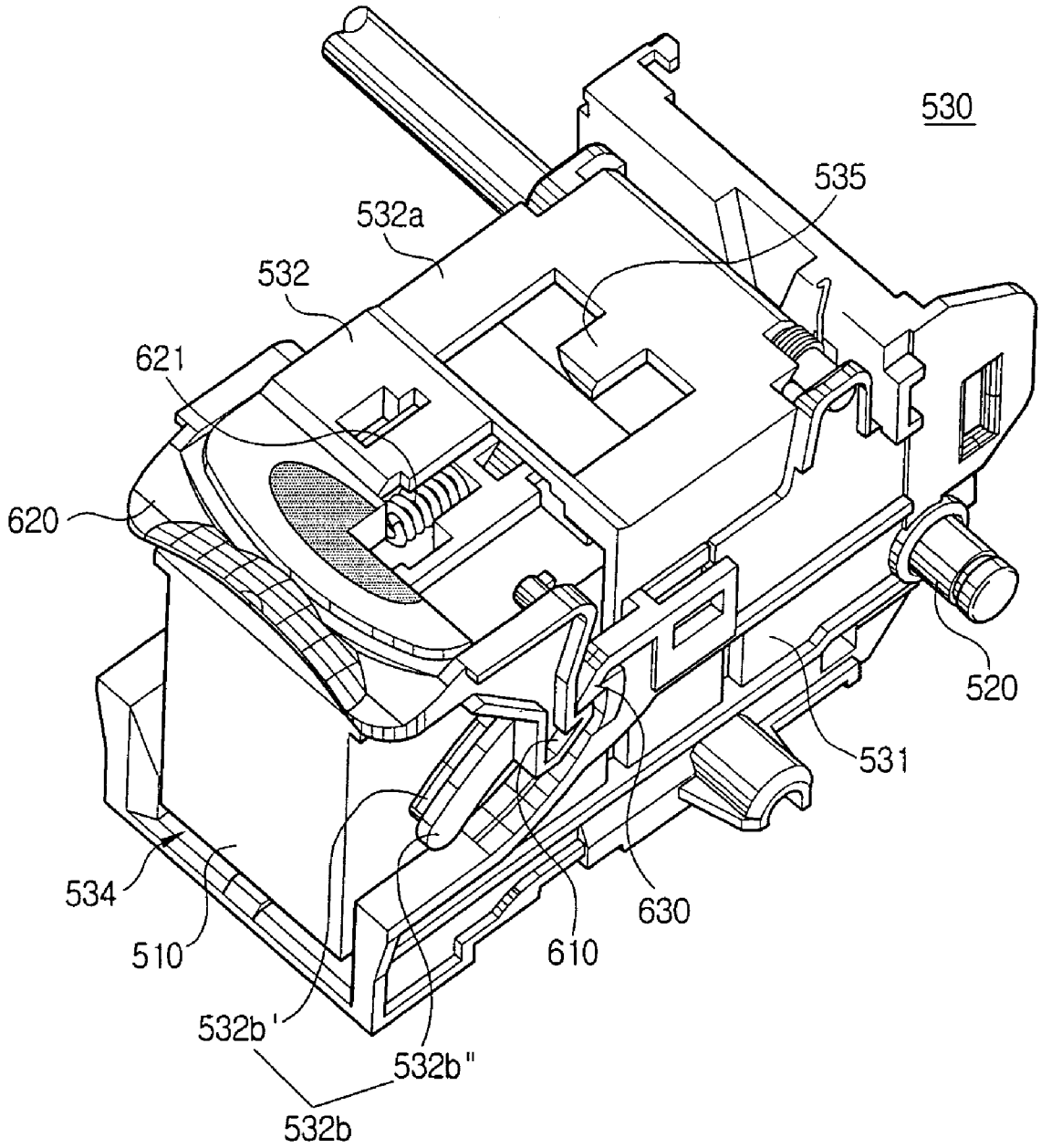
FIG. 8 is a perspective view showing a carriage for an ink cartridge according to a second embodiment of the present invention.
Figure 9:
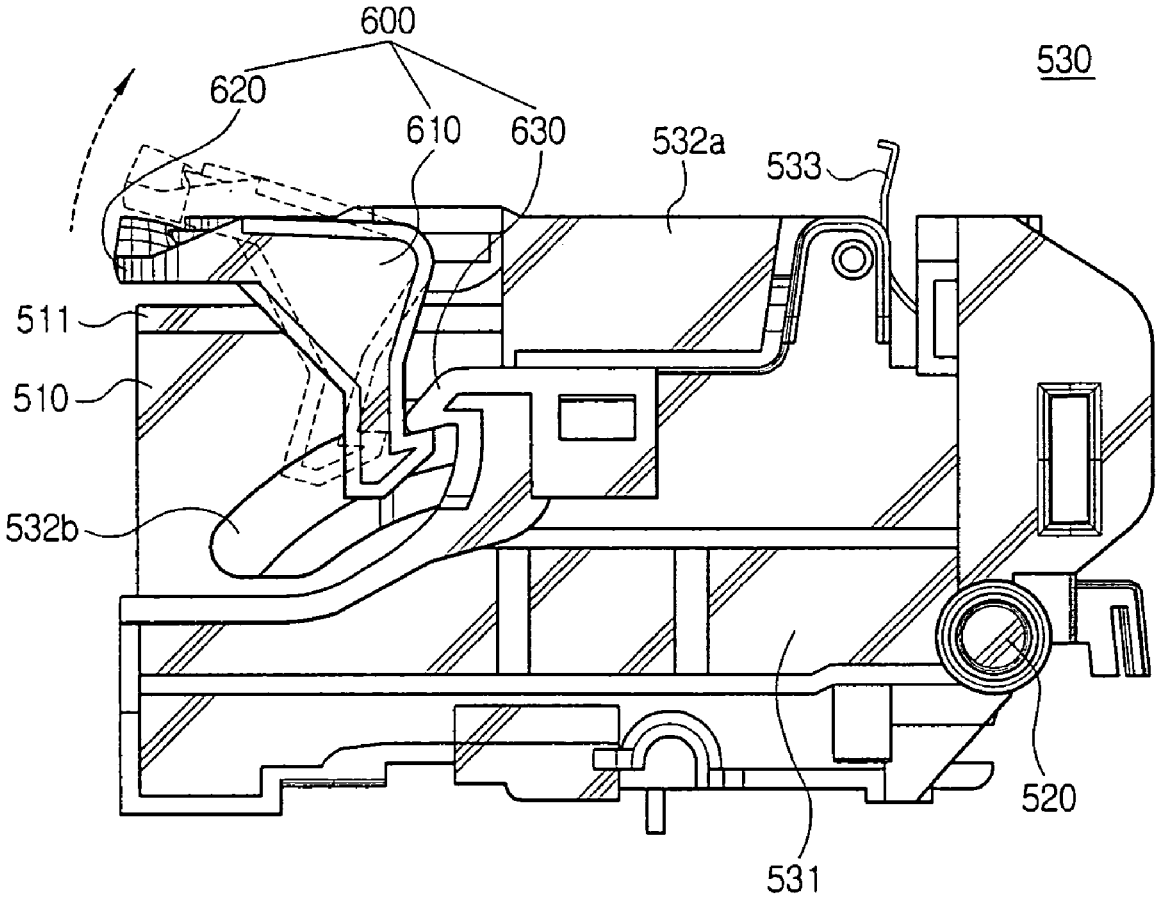
FIG. 9 is a side elevation view of FIG. 8 to explain an unlocking method of the latch.

Referring to FIGS. 8 and 9, according to the second embodiment, there is provided an ink cartridge 510, a guide rail 520, and a carriage 530.

The ink cartridge 510, which discharges ink contained in a body thereof through a nozzle disposed at a lower surface of the ink cartridge 510 according to a print signal of a controller, has a latching portion 511 positioned along an upper and outer circumference of the ink cartridge 510, to allow the ink cartridge 510 to be easily mounted and removed. This is to maximize a moment force applied by a guide arm 532*b* during removal of the ink cartridge 510, thereby enabling a user remove the ink cartridge 510 with less effort.

The guide rail 520 is disposed in a body of the ink jet printer, to support the carriage 530 and guide a printing path.

The carriage 530 includes a carriage body 531, a latch 532, a resilient latch member 533, and a locking unit 600. The carriage body 531 is provided with a mounting portion 534 to accommodate the ink cartridge 510 thereon, and reciprocally moves along the guide rail 520.

The latch 532 is pivotably disposed at the carriage body 531, to open and close an opening portion of the carriage body 531, through which the ink cartridge 510 is mounted and removed. The latch 532 draws out and separates the ink cartridge 510 from the mounting portion 534 during an opening operation.

The latch 532 includes a latch body 532*a*, and the guide arm 532*b* extending from the latch body 532*a*, to guide side surfaces of the ink cartridge 510. According to one aspect, the guide arm 532*b* includes: a first guide portion 532*b*' that hooks into the latching portion 511 during the opening operation, to lift up the ink cartridge 510; and a second guide portion 532*b*" extending stepwise from the first guide portion 532*b*', to guide the latching portion 511.

The first and the second guide portions 532*b*' and 532*b*", respectively, have inclined surfaces, each setting an angle to the horizontal when the latch 532 is locked with an inclination having an upward tendency relative to an advancing direction of the ink cartridge 510. That is, the guide arm 532*b* having the first and the second guide portions 532*b*' and 532*b*", is shaped in an arc having a predetermined curvature, so that the ink cartridge 510 advances toward a lower surface of the carriage. Due to the guide arm 532*b* having the predetermined curvature, an area where an upper surface of the first guide portion 532*b*' contacts with a lower surface 511' (see FIG. 12) of the latching portion 511 increases as the latch 532 is opened. Also, since the guide arm 532*b* contacts the ink cartridge 510 at a position that is in front of a center of gravity of the ink cartridge 510, a user removes the ink cartridge 510 with less effort.

On a surface of the latch 532 opposite to the ink cartridge 510, there is provided a plunger 535 integrally formed with the latch body 532*a*. As the latch 532 is locked, the plunger 535 elastically deforms to compress the ink cartridge 510 and secure a head of the ink cartridge 510 mounted in the carriage 532.

The resilient latch member 533 resiliently biases the latch 532 in an opening direction. Due to the presence of the resilient latch member 533, the opening of the latch 532 is easily performed.

The locking unit 600 locks the latch 532 in a closed position, and includes a hook member 610, a release handle 620 and a locking projection 630. The hook member 610 is pivotably disposed at the latch 532 and has a locking protrusion 611 (not shown—similar to locking protrusion 211 of FIG. 3) that locks the locking projection 630.

According to one aspect, a pair of opposite hook members 610 are provided with the ink cartridge 510 interposed therebetween. Accordingly, the pair of hook members 610 simultaneously hook into the locking projections 630 at both sides, to prevent the latch 532 from deviating from a predetermined position while being opened or locked.

The release handle 620 pivots the hook member 610 in an unlocking direction, and according to one aspect, is integrally formed with the hook member 610, and pivotably hinged on the latch 532. In this case, the hook member 610 extends from the release handle 620, and is concurrently rotated and released from the locking projection 630 simultaneously with the lifting of the release handle 620 in an arrowed direction of FIG. 9. According to one aspect, however, the release handle 620 and the hook member 610 are separately formed. In this case, the hook member 610 and the release handle 620 are connected to each other and move in association with each other.

Also, the release handler 620 may be further provided with a resilient release handle member 621 to ensure a close contact between the hook member 610 and the locking projection 630. The resilient release handle member 621 uses a spring that is interposed between the latch 532 and the release handle 620 as shown in FIG. 8. When the release handle 620, including the resilient release handle member 621, is no longer controlled by a user, the release handler 620 automatically returns to an initial locked position, and as a result, user convenience is improved.

According to one aspect, the locking projection 630 is disposed at a sidewall of the carriage body 531 to engage the locking protrusion 611.

As shown in FIGS. 8 to 14, the locking projection 630 and the hook member 610 respectively, have sliding slants. The sliding slants are positioned so that the respective contacting surfaces of the hook member 610 and the locking projection 630 slide on each other when the latch 532 is locked.

Figure 10A:
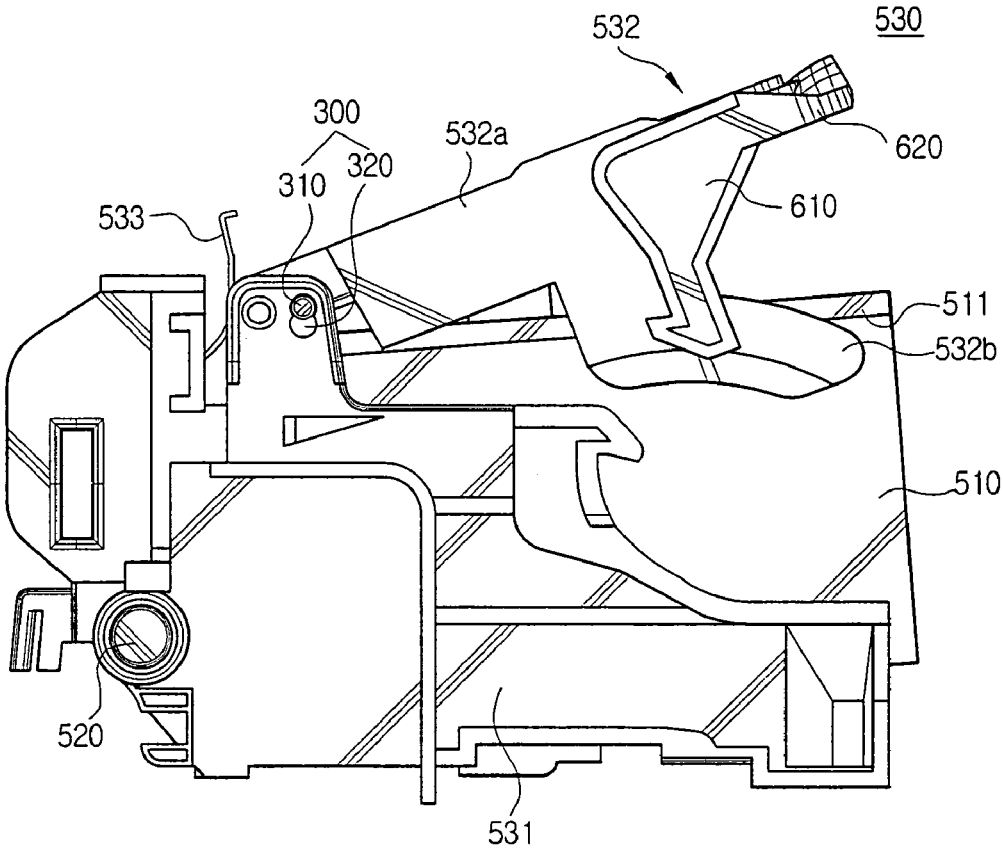
FIG. 10A is a left side elevation view of FIG. 8 showing an ascending latch hooking the ink cartridge.
Figure 10B:
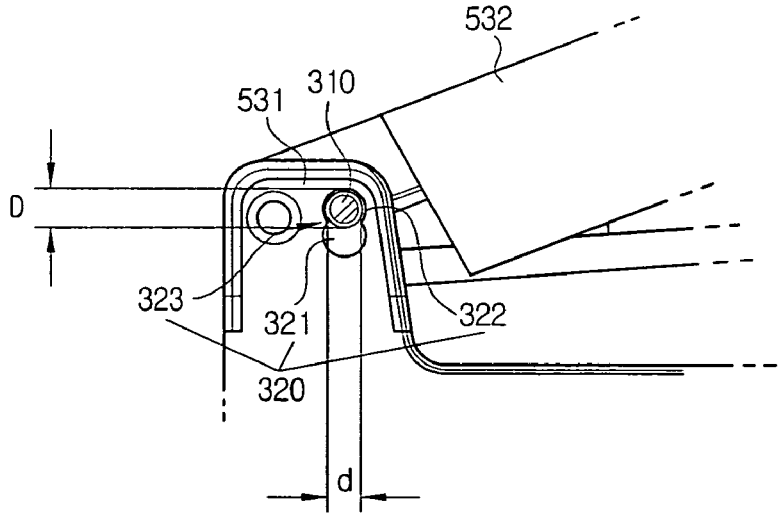
FIG. 10B is an enlarged view showing main parts of FIG. 10A.
Figure 14:
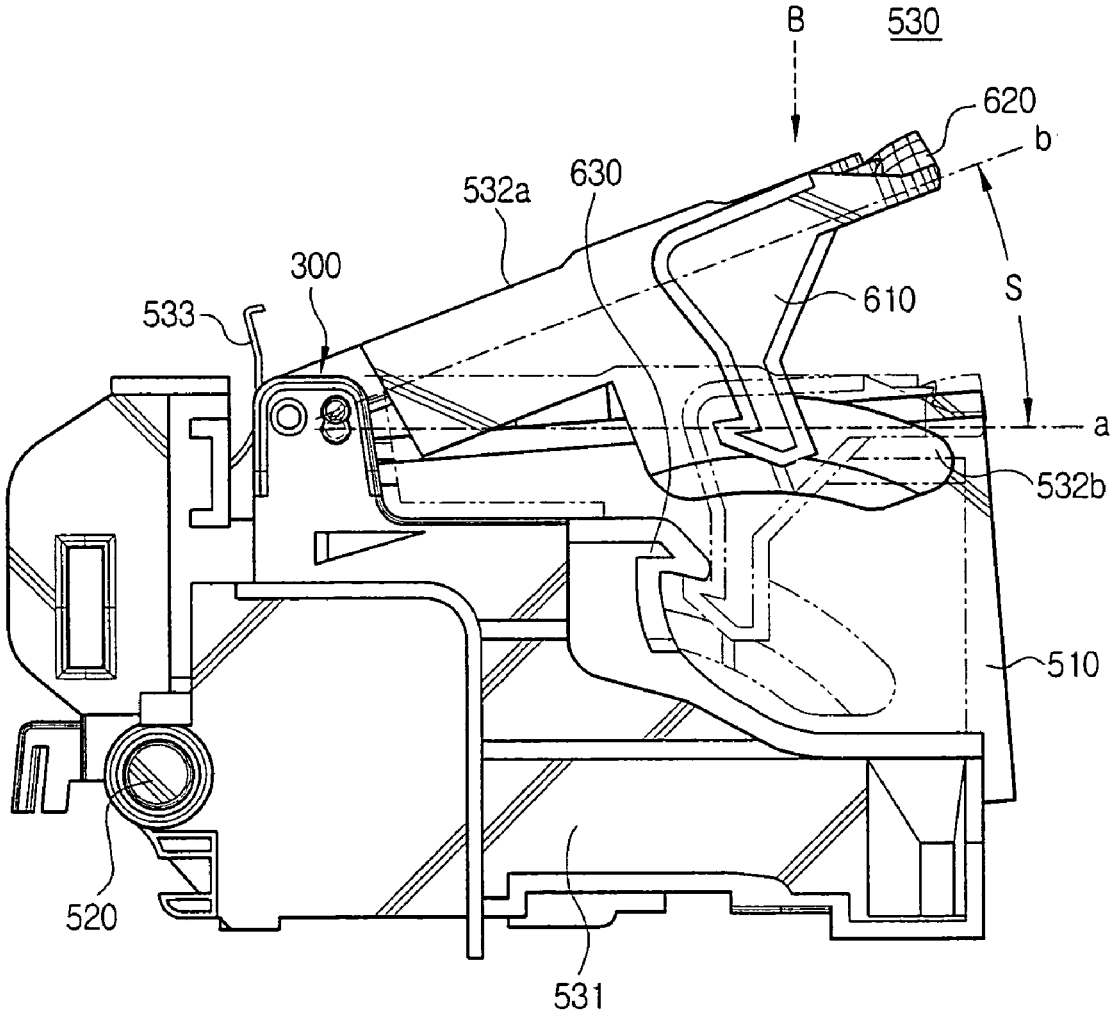
FIG. 14 is a side elevation view showing the carriage for the ink cartridge of FIG. 8 with the latch being locked.

Meanwhile, as shown in FIGS. 10A and 10B, a sliding unit 300 is provided at the carriage body 531 and the latch 532, to limit an opening angle of the latch 532. This opening angle "S" is shown in FIG. 14.

The sliding unit 300 includes a sliding protrusion 310 disposed at the latch 532, and a sliding hole portion 0.320 disposed in the carriage body 531, that corresponds to the sliding protrusion 310. According to one aspect, the sliding protrusion 310 is a cylinder that protrudes from the latch body 532*a*.

The sliding hole portion 320 is defined in the carriage body 531 to correspond to the sliding protrusion 310. The sliding hole portion 320 includes a first penetrating hole 321, a second penetrating hole 322, and a connection portion 323 connecting the first and the second penetrating holes 321 and 322. The sliding protrusion 310 is received in the first penetrating hole 321 at a first position when the latch 532 is locked. And the sliding protrusion 310 is received in the second penetrating hole 322 at a second position when the latch 532 is opened to the maximum degree.

According to one aspect, the first and the second penetrating holes 321 and 322 have the same diameter. According to another aspect, the first penetrating hole 321 has a greater diameter than that of the second penetrating hole 322, to achieve a smooth locking of the latch 532.

The connection portion 323 has a distance "d" between opposing surfaces thereof, which is smaller than a diameter "D" of the sliding protrusion 310. If the distance "d" of the connection portion 323 is too small, the sliding protrusion 310 cannot slide toward the second penetrating hole 322. In this case, the latch 532 would not open. On the contrary, if the distance "d" of the connection portion 323 is too large, the sliding protrusion 310 is not supported by the connection portion 323 in the second penetrating hole 322 when the latch 532 is opened. In this case, the latch 532 is unstably opened, and thus, when the latch 532 is no longer controlled by a user, the latch 532 returns to the initial locking position due to self-weight. Thus, according to one aspect, it is preferred that the distance "d" of the connection portion 232 corresponds to 80%~90% of the diameter "D" of the sliding protrusion 310.

Accordingly, when the latch 532 is opened, since the sliding protrusion 310 is received in the second penetrating hole 322 of the carriage body 531 and also supported in the connection portion 323, the opening state of the latch 532 is stably maintained, to thus open the mounting portion 534.

Also, the sliding unit 300 restricts the opening angle "S" of the latch 532. According to one aspect, the opening angle "S", which is an interior angle between a first imaginary line "a" parallel to an upper surface of the latch 532 at the locking position, and a second imaginary line "b" parallel to the upper surface of the latch 532 at a maximum opening position, is within a range of approximately 20° to 30° (see FIG. 14). If the opening angle "S" is greater than the range, then, when a user inserts the ink cartridge, the latching portion 511 does not contact the upper surface of the first guide portion 532*b*', but rather, advances under the first guide portion 532*b*', so that the ink cartridge 510 is not locked. Also, if the opening angle "S" is less than the range, it is difficult for a user to insert and remove the ink cartridge. According to one aspect, the opening angle "S" is approximately 21°.

Therefore, the sliding unit 300 maintains the latch 532 at the opening angle "S" of 21°, thereby minimizing an error that may otherwise occur when the ink cartridge 510 is replaced with a new ink cartridge.

Reference will now be made to the operations of inserting and removing the ink cartridge 510, with reference to the accompanying drawings.

Referring to FIGS. 8 and 9, the ink cartridge 510 is accommodated in the mounting portion 534 provided in the carriage body 531 of the carriage 530, and secured by the locking unit 600.

When the ink cartridge 510 is completely consumed and thus has to be replaced with a new ink cartridge 510, a user presses the latch 532 with his/her thumb and lifts the release handle 620 in the arrowed direction of FIG. 9 with his/her index finger or middle finger.

As the release handle 620 is lifted, rotation of the release handle 620 causes the hook member 610 to rotate in an unlocking direction i.e. in the arrowed direction of FIG. 9.

Accordingly, as the hook member 610, engaged with the locking projection 630 during a locking state, is rotated in the arrowed direction of FIG. 9, the latch 532 is released from the locking state, as shown in FIG. 10A, and the latch 532 receives a rotation force in the opening direction due to the resilient recovering force of the resilient latch member 533 and the plunger 535.

Figure 11:
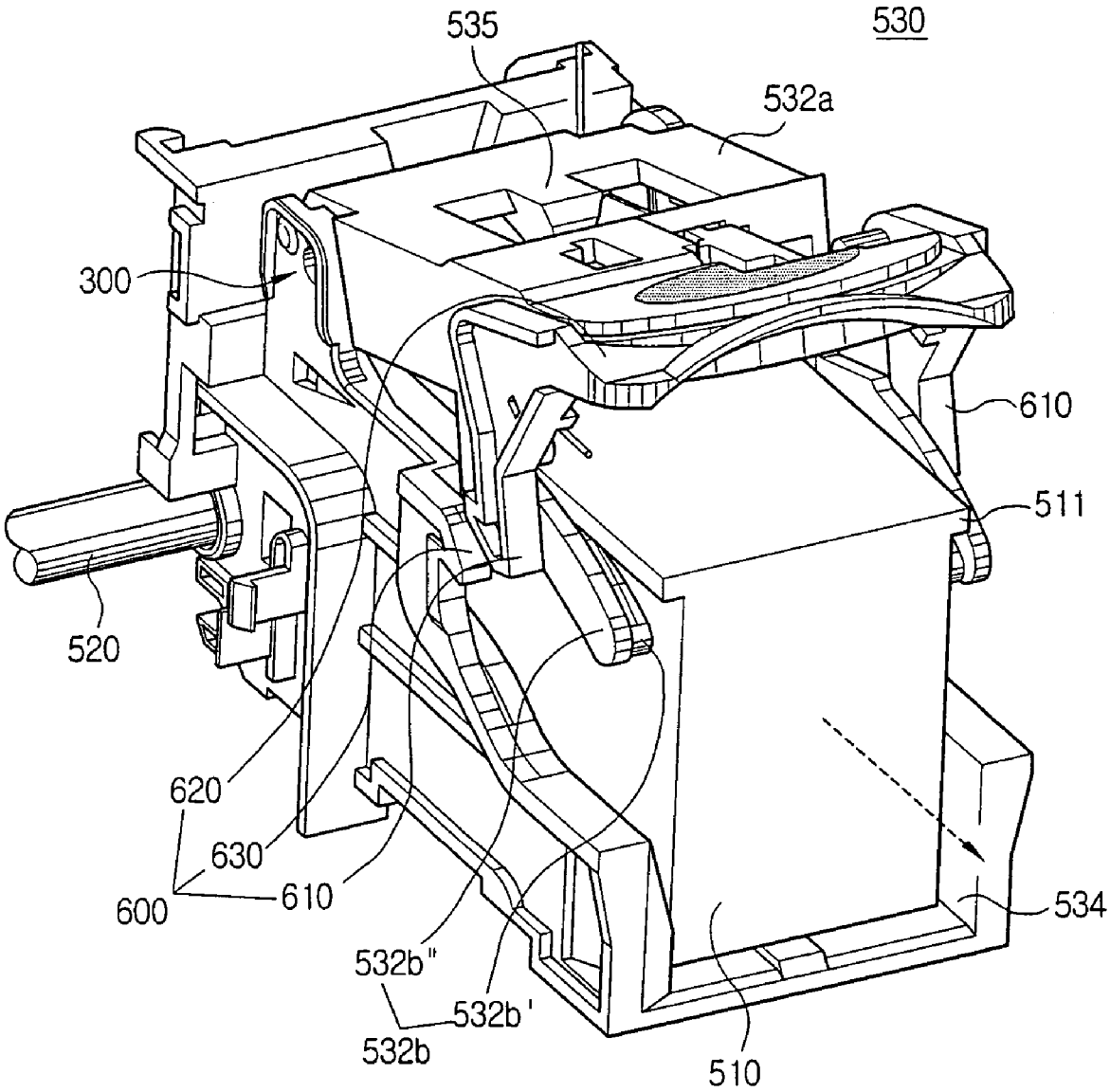
FIG. 11 is a perspective view showing the carriage of FIG. 8 with the latch being released open.
Figure 12:
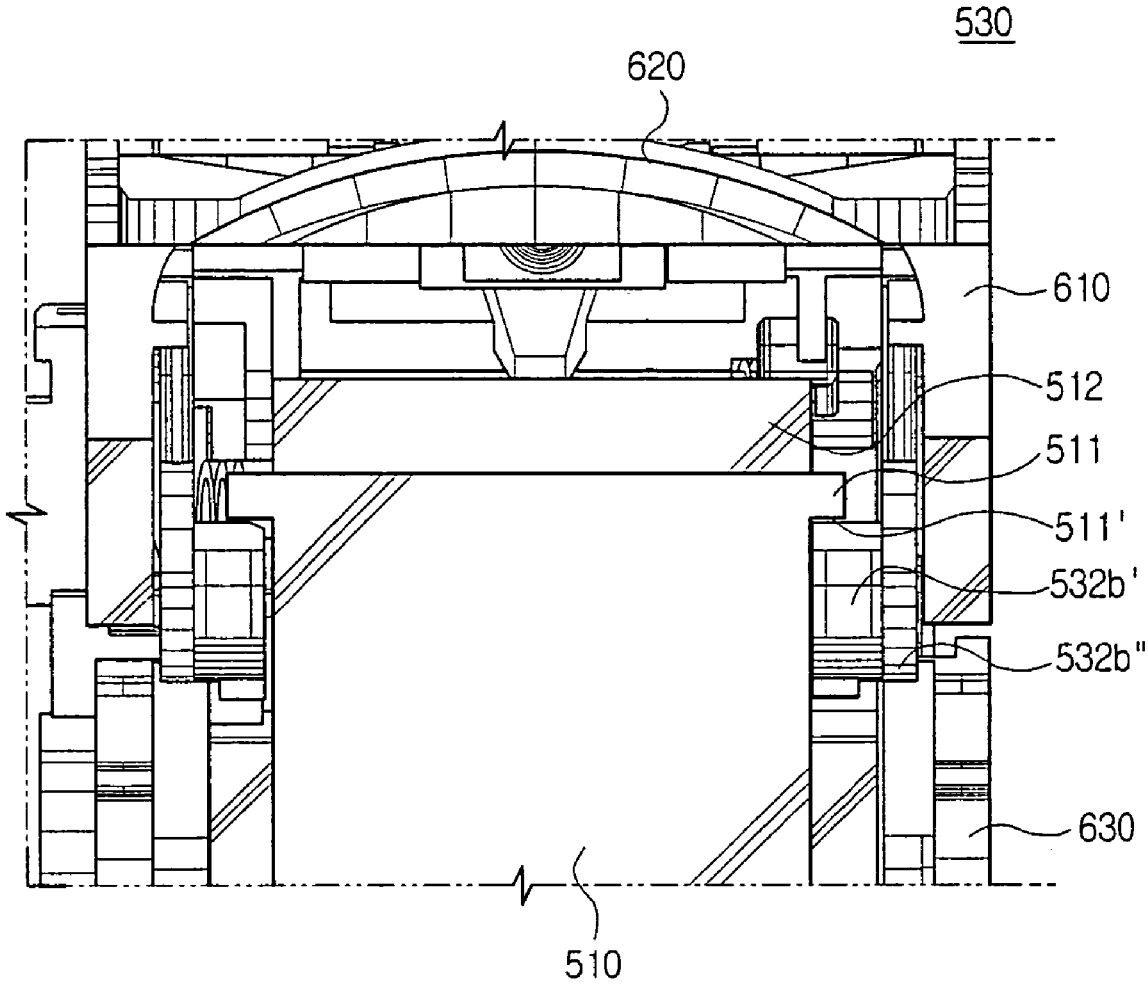
FIG. 12 is a front view showing main parts of FIG. 11.
Figure 13:
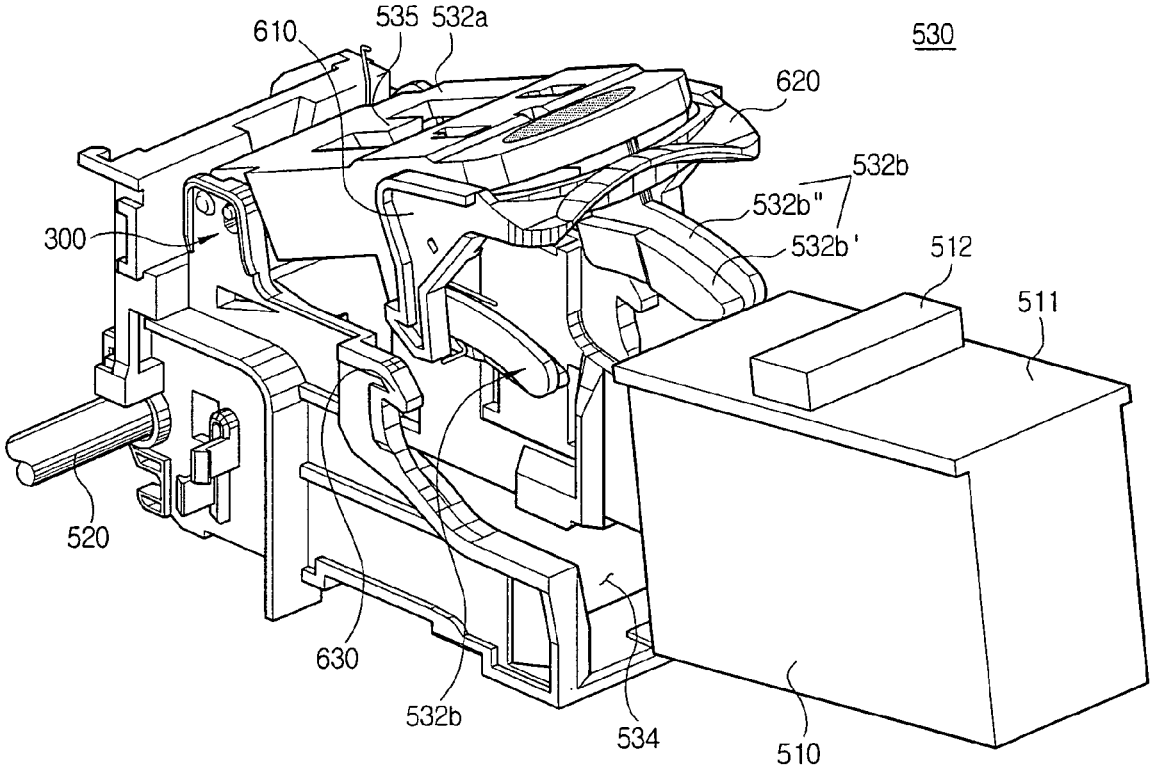
FIG. 13 is a perspective view showing the ink cartridge before the ink cartridge is mounted in the carriage of FIG. 8.

The latch 532 released from the locking state is opened to the maximum degree by the user as shown in FIGS. 11 and 12, to remove the ink cartridge 510 in an arrowed direction of FIG. 11.

As shown in the drawings, the latch 532 is provided with the guide arms 532*b* positioned at opposing sides to support the ink cartridge 510. Each guide arm 532*b* includes the first guide portion 532*b*' supporting the latching portion 511 of the ink cartridge 510, and the second guide portion 532*b*" supporting a side surface of the latching portion 511.

Accordingly, when the latch 532 is opened, the ink cartridge 510 comes into contact with the guide arms 532*b*, and is separated from the mounting portion 534 in a manner such that the lower surface 511' of the latching portion 511, which protrudes from an upper surface of the ink cartridge 510, slides in contact with an upper surface of the first guide portion 532*b*'. That is, the ink cartridge 510 is drawn out of the mounting portion 534 in association with the ascending movement of the guide arm 532*b*.

The sliding unit 300 limits the opening angle "S" of the latch 532 to approximately 21°, and thus the latch 532 is supported by the connection portion 323 at the maximum opening position and stops opening. When the latch 532 reaches the maximum opening position, the sliding protrusion 310 protruding from the latch body 532*a* slides into the second penetrating hole 322 of the sliding hole portion 320. Since the distance "d" of the connection portion 323 is smaller than the diameter "D" of the second penetrating hole 322, the sliding protrusion 310 is supported by a wall surface of the connection portion 323 at an entrance of the connection portion 323. Accordingly, the latch 532 is fixed at the maximum opening position.

When the ink cartridge 510 is separated from the mounting portion 534, a user removes the ink cartridge 510 in the arrowed direction of FIG. 11. Then, the user inserts a new ink cartridge 510 in a manner such that the upper surface of the first guide portion 532*b*' contacts with the lower surface 511' of the latching portion 511. The inserting movement of the ink cartridge 510 continues until a projection 512 comes into contact with the plunger 535. If the insertion is not complete, the latch 532 does not lock the ink cartridge 510 properly.

When the inserting of the ink cartridge 510 is complete, a user presses an upper surface of the latch 532 in an arrowed direction of B as shown in FIG. 14, and mounts the ink cartridge 510 in the mounting portion 534. The hook member 610 and the locking projection 630 have the sliding slants on the opposing surfaces thereof. Accordingly, the hook member 610 slides on the sliding slant of the locking projection 630, and rotates together with the release handle 620 in contact with the sliding slant by a predetermined angle. Thereafter, the hook member 610 returns to the locking position by a resilient recovering force of the resilient release handle member 621, and hooks the locking projection 630.

Also, the plunger 535 provided on the latch 532 resiliently compresses the projection 512 disposed on the upper surface of the ink cartridge 510, thereby firmly securing the ink cartridge 510 to the mounting portion 534 of the carriage 530.

Accordingly, in case that there occurs an external shock to the ink jet printer, the carriage 530 having the locking device as described above provides a stable locking of the ink cartridge 510. Also, since the user can easily install and remove the ink cartridge 510 precisely, improper operation of the printer is prevented, and the user convenience is improved.

Further, since there is the hook member 610 pivotably disposed at the latch 532 to hook the locking projection 630, the ink cartridge is prevented from being separated from the carriage 530 by the external shock. Also, since the ink cartridge 510 is guided to the mounting position without deviation, due to the presence of the guide arm 532*b* formed integrally with the latch 532, mistakes occur less frequently when the user replace the ink cartridge 510 with a new ink cartridge 510.

Also, since the latch 532 is maintained in an open state until the ink cartridge 510 is re-mounted, the user is not required to open the latch again to mount the ink cartridge 510. Accordingly, the user convenience is improved.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A carriage for an ink cartridge of an image forming apparatus comprising:

a carriage body having a mounting portion, in which the ink cartridge having a latching portion is accommodated;

a latch rotatably disposed at the carriage body to close the mounting portion by locking, that when unlocking with respect to the carriage body, draws the ink cartridge out of the mounting portion;

a resilient latch member to resiliently bias the latch in an opening direction;

a locking unit to lock the latch to the carriage body; and a sliding unit that limits an opening angle of the latch with respect to the carriage body, wherein the sliding unit comprises:

a sliding protrusion disposed on the latch; and a sliding hole portion disposed on the carriage body opposite to the sliding protrusion, to accommodate the sliding protrusion, and wherein the sliding hole portion comprises:

a first penetrating hole receiving the sliding protrusion at a first position when the latch is locked;

a second penetrating hole receiving the sliding protrusion at a second position when the latch is opened; and a connection portion connecting the first and the second penetrating holes.

2. The carriage of claim 1, wherein the connection portion has a distance defined between opposing surfaces thereof that is smaller than a diameter of the sliding protrusion.

3. A carriage for an ink cartridge, comprising:

a carriage body, movable on a guide rail, and having a mounting portion to receive the ink cartridge, and an opening, through which the ink cartridge is selectively installed;

a latch, rotatably connected to the carriage body, to selectively open and close the opening;

a resilient latch member to resiliently bias the latch in an opening direction; and a locking unit to lock the latch to the carriage body, wherein the ink cartridge is lifted from the mounting portion when the latch opens the opening, and wherein the locking unit comprises:

a locking projection connected to the carriage body;

a release handle rotatably connected to the latch; and a hook member rotatably connected to the latch, that engages and disengages the locking projection when the release handle is rotated in a locking direction and an unlocking direction, respectively.

4. The carriage according to claim 3, wherein:

the release handle and the hook member are integrally formed.

5. The carriage according to claim 3, wherein:

the hook member and the release handle rotate coaxially.

6. The carriage according to claim 5, wherein:

the hook member and the release handle are integrally formed, and rotate concurrently.

7. The carriage according to claim 3, wherein:

the hook member and the release handle rotate concurrently.

8. The carriage according to claim 3, wherein the release handle comprises:

a resilient release handle member to bias the hook member toward the locking projection.

9. The carriage according to claim 8, wherein the resilient release handle member comprises:

a spring interposed between the latch and the release handle.

10. The carriage according to claim 3, wherein:

the locking projection is positioned at a side wall of the carriage body.

11. The carriage according to claim 3, wherein the latch comprises:

a latch body rotatably connected to the carriage body; and a guide arm extending from the latch body to guide side surfaces of the ink cartridge.

12. The carriage according to claim 11, wherein:

the ink cartridge comprises a latching portion positioned at the side surfaces of the ink cartridge; and the guide arm comprises a first guide portion that engages the latching portion to lift the ink cartridge when the latch opens the opening, and a second guide portion extending stepwise from the first guide portion to guide the latching portion.

13. The carriage according to claim 12, wherein:

the guide arm has a predetermined curvature so that the ink cartridge moves toward the mounting portion when the ink cartridge is removed from the carriage body.

14. The carriage according to claim 13, wherein:

an area where a first surface of the first guide portion contacts a first portion of the latching portion increases as the latch opens the opening.

15. The carriage according to claim 11, further comprising:

a sliding unit to limit an opening angle of the latch.

16. The carriage according to claim 15, wherein the sliding unit comprises:

a sliding protrusion protruding from the latch body; and a sliding enclosure positioned in the carriage body to correspond to the sliding protrusion, and in which the sliding protrusion moves.

17. The carriage according to claim 16, wherein the sliding protrusion is approximately cylindrical.

18. The carriage according to claim 17, wherein the sliding enclosure comprises:

a first enclosure region;

a second enclosure region; and a connection region, connecting the first and second enclosure regions, wherein the sliding protrusion is received in the first enclosure region when the latch has closed the opening, and the sliding protrusion is received in the second enclosure region when the latch has opened the opening.

19. The carriage according to claim 18, wherein:

the first and second enclosure regions have approximately the same diameter.

20. The carriage according to claim 18, wherein:

a diameter of the first enclosure region is larger than a diameter of the second enclosure region.

21. The carriage according to claim 18, wherein:

a distance between opposing surfaces of the connection region is smaller than a diameter of the sliding protrusion.

22. The carriage according to claim 21, wherein:

the distance between the opposing surfaces of the connection region is approximately 80-90% of the diameter of the sliding protrusion.

23. The carriage according to claim 15, wherein:

the opening angle is limited by the sliding unit to approximately 20-30°, wherein the opening angle is defined at an intersection between a first imaginary line parallel to a first surface of the latch when the latch has closed the opening, and a second imaginary line parallel to the first surface of the latch when the latch has opened the opening.

24. The carriage according to claim 23, wherein:

the opening angle is limited by the sliding unit to approximately 21°.

* * * * *